US005909160A

United States Patent [19]

Dick et al.

[11] Patent Number: 5,909,160

[45] **Date of Patent: *Jun. 1, 1999**

[54] TEMPERATURE COMPENSATED SAPPHIRE RESONATOR FOR ULTRASTABLE OSCILLATOR OPERATING AT TEMPERATURES NEAR 77° KELVIN

[75] Inventors: G. John Dick, Claremont; David G. Santiago, Altadena, both of Calif.

[73] Assignee: The United State of America as the National Aeronautics and Space Administration, Washington, D.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/538,433

[22] Filed: Aug. 9, 1995

[51] Int. Cl.[6] ..... H01P 7/10

[52] U.S. Cl. ..... 333/234; 331/96

[58] Field of Search ..... 333/234, 229, 333/219.1, 202, 202 DR; 331/96, 107 DP

[56] References Cited

U.S. PATENT DOCUMENTS 5,059,929 10/1991 Tanaka ..... 333/234 X

OTHER PUBLICATIONS

S.L. Abramov, Ye. N. Ivanov and D.P. Tsarapkin, "A Low–Noise Self–Excited Microwave Oscillator with a Thermally Compensated Disk Dielectric Resonator," Radiotechnika, No. 11, pp. 81–83, (1988), reprinted in English, Telecom and Radio Engineering, vol. 43, No. 12, pp. 127–129, (1990).

D.P. Tsarapkin, "An Uncooled Microwave Oscillator with 1–Million Effective Q–Factor," Proc. 1993 IEEE International Frequency Control Symposium, pp. 779–783, (1993).

Chen et al, "Tunable, Hybrid Mode Dielectric Resonators with Temperature Compensation"; *Applied Microwaves*; Aug./Sep. 1989; pp. 66–69.

Santiago D.G. and Dick, G.J.; "Closed Loop Tests of the NASA Sapphire Phase Stabilizer"; 1993 *IEEE Int'l Frequency Control Symposium* Proceedings; pp. 774–777.

*Primary Examiner*—Benny T. Lee
*Attorney, Agent, or Firm*—John H. Kusmiss

[57] ABSTRACT

A sapphire resonator for an ultrastable oscillator capable of substantial performance improvements over the best available crystal quartz oscillators in a compact cryogenic package is based on a compensation mechanism enabled by the difference between copper and sapphire thermal expansion coefficients for so tuning the resonator as to cancel the temperature variation of the sapphire's dielectric constant. The sapphire resonator consists of a sapphire ring separated into two parts with webs on the outer end of each to form two re-entrant parts which are separated by a copper post. The re-entrant parts are bonded to the post by indium solder for good thermal conductivity between parts of that subassembly which is supported on the base plate of a closed copper cylinder (rf shielding casing) by a thin stainless steel cylinder. A unit for temperature control is placed in the stainless steel cylinder and is connected to the subassembly of re-entrant parts and copper post by a layer of indium for good thermal conduction. In normal use, the rf shielding casing is placed in a vacuum tank which is in turn placed in a thermos flask of liquid nitrogen. The temperature regulator is controlled from outside the thermos flask to a temperature in a range of about 40° to 150° K, such as 87° K for the $WGH_{811}$ mode of resonance in response to microwave energy inserted into the rf shielding casing through a port from an outside source.

7 Claims, 6 Drawing Sheets

TEMPERATURE COMPENSATED SAPPHIRE RESONATOR FOR ULTRASTABLE OSCILLATOR OPERATING AT TEMPERATURES NEAR 77° KELVIN

ORIGIN OF THE INVENTION

The invention described herein was made in the performance of work under a NASA contract, and is subject to the provisions of Public Law 96–517 (35 U.S.C. 202) in which the Contractor has elected not to retain title.

TECHNICAL FIELD

This invention relates to a type of sapphire resonator commonly called a "Whispering Gallery" sapphire resonator (hereinafter referred to as a WG sapphire resonator or simply a sapphire resonator) designed for the dominant ($WGH_{n11}$) microwave mode family to be temperature compensated for frequency stable operation at temperatures near 77° K (i.e., in a range of about 40° to 150° K).

BACKGROUND ART

A WG sapphire resonator consists of a ring or disk of sapphire inside a metallic cylindrical casing for electromagnetic shielding of and confining resonating rf fields to the sapphire element. These resonators effectively eliminate rf conduction losses and thus make possible oscillators that are only limited by performance of the sapphire itself. The sapphire is typically oriented with its crystal c-axis along the axis of the cylindrical casing in order to achieve cylindrical symmetry for the excited electromagnetic resonance modes.

WG electromagnetic modes can be divided into families depending on their field configuration, and further characterized by the number n of full waves around the perimeter of the sapphire ring or disk. The modes are doubly degenerate, with azimuthal phase of the two submodes differing by 90°. Modes typically used are the $WGH_{n11}$ family for ring resonators and the $WGE_{n11}$ family for flat disk resonators, where $n \geqq 5$. WG denotes Whispering Gallery and $H_{n11}$ denotes electric field loops formed in the annular body of a wheel or ring, and $E_{n11}$ denotes electric field loops formed in the planar body of a sapphire disk.

With very high microwave quality factors (Q's) at easily reached cryogenic temperatures, the sapphire resonators already make possible excellent phase noise performance. In principle, the high Q values also make possible high frequency stability, but only if the resonator itself were stable. Temperature fluctuations in the sapphire cause unwanted frequency fluctuations in the resonator. If these frequency variations could be cancelled or compensated, high stability could be achieved.

Q of the WG sapphire resonator increases rapidly as the temperature is cooled, from approximately Q=300,000 at 300° K (room temperature) to 30 million at 77° K (for X-band frequencies≈8 GHz). This compares to Q values of 1 to 2 million for the best available crystal quartz oscillators, and 10,000 to 20,000 for metallic microwave cavities. Consequently, when coupled with low noise microwave circuitry, the high sapphire Q theoretically could make possible long term frequency stability as low as $10^{-14}$ were it not for unwanted temperature fluctuations in the resonator casing. Such a stability would be 20 times better than that achievable by quartz oscillators of the highest quality, which presently provide a stability of $2\times10^{-13}$.

Various approaches for compensated operation have been developed to reduce thermal variations in electromagnetic or acoustic (piezoelectric) resonators in order to achieve high frequency stability. Compensated operation for bulk acoustic-wave quartz oscillators is achieved by means of an appropriate choice of orientation for the quartz crystal. This is possible due to a very strong variability of acoustic parameters with crystal direction. Electromagnetic sapphire resonators have a much smaller anisotropy (≈35%) and no sign reversal for any of its thermal dependencies. In fact, up to the present time useful compensation of sapphire resonators has only been possible at liquid helium temperatures, where incidental or added paramagnetic impurities give an effective compensating effect. But helium temperature operation is expensive, and impractical for most applications. A compensation mechanism for operation at 77° K or above would allow liquid nitrogen to be used as the coolant in a very much smaller Dewar and less expensive compensation mechanism.

Temperature sensitivity of the operating frequency is characteristic of all electromagnetic and acoustic resonators due to thermally induced variation of the size, dielectric constants, speed of sound, etc., for solid state materials. Fractional variation of these parameters is typically $10^4$ to $10^5$ parts per degree Kelvin. Consequently, achieving resonator stabilities of $10^{-13}$ to $10^{-14}$ would require nanodegree control of temperature stability, an impossible task. Yet such a high degree of stability is desired for use as a stable local oscillator for an atomic frequency standard (atomic clock) of the type disclosed by John D. Prestage in U.S. patent application Ser. No. 08/246,041 titled *Extended Linear Ion Trap Frequency Standard Apparatus,* now U.S. Pat. No. 5,420,549. The majority of such frequency standards required for various commercial, scientific and military applications are based on quartz crystal oscillators. A sapphire resonator has the potential for greater stability in many such applications.

Available techniques for higher stability and reduced thermal variation in resonator frequencies are:

- Very low cryogenic temperatures (T<10° K) can be used to "freeze out" the thermally-induced variations, which vary as a function of $T^3$ as the temperature of components varies. This technique has been successfully applied to super-conducting, superconductor-on-sapphire, and WG sapphire resonators. However, the very low helium temperature required makes such systems large and expensive, and therefore impractical for most applications.
- An inherently weak tuning mechanism may be used at the lowest temperatures to provide complete cancellation. In this way paramagnetic impurities can compensate the thermal variation in sapphire resonators for $T \leqq 6°$ K, but again, operation at such low liquid helium temperatures is impractical for most applications.
- The differing thermal coefficients for various properties of the resonator components can be played against each other in such a way that, for some operating temperature, thermal frequency variations are compensated or cancelled. Piezoelectric quartz resonators are compensated in this way by an appropriate orientation of this strongly anisotropic crystal (e.g. "SC" or "AT" cut quartz resonators). Unfortunately, an orientation dependent cancellation does not occur for electromagnetic resonators where the anisotropy is much smaller (i.e., where the temperature dependencies vary by only about ≈30% as the orientation is changed).
- A resonator may be constructed using several similar materials with compensating thermal characteristics.

For example, dielectric resonators for oscillators are typically stabilized by use of several materials with thermal dielectric variations of opposite sign.

A mechanical tuning mechanism may be driven by thermal expansion coefficients of the construction materials. This mechanism has been previously applied to a sapphire resonator at room temperature using a highly re-entrant geometry to achieve very low phase noise and a stability of $4\times10^{-8}$ over a period of ten seconds. [S. L. Abramov, Ye. N. Ivanov and D. P. Tsarapkin, "A Low-Noise Self-Excited Microwave Oscillator with a Thermally Compensated Disk Dielectric Resonator," *Radiotechnika,* No. 11, 81–83 (1988), reprinted in English, *Telecom & Radio Engineering,* Vol. 43, No. 12, pp. 127–129 (1990) and D. P. Tsarapkin, "An Uncooled Microwave Oscillator with 1-Million Effective Q-Factor," *Proc.* 1993 *IEEE International Frequency Control Symposium,* pp. 779–783 (1993)]. Ultrahigh frequency stability better than $7.4\times10^{-7}$ per degree Kelvin was probably precluded by attempting to operate at room temperature with a design using brass and Invar which are alloys having poor thermal conductivity and using two brass parts joined by a sliding (threaded) joint which also has a poor thermal conductivity, thus giving rise to temperature gradients in the compensation mechanism.

Material Properties

Factors affecting sensitivity of the sapphire resonator's frequency to temperature are:

Variation of the dielectric constants $\epsilon$ with temperature is the greatest factor. As shown in FIG. 1, the dielectric constants vary by 80 to 140 parts per million (PPM) per degree Kelvin at room temperature 300° K, as shown by graphs A and B for variations parallel and perpendicular to the resonator axis. The resulting change in frequency f is just half this value, or 40 to 70 PPM per degree Kelvin (since f $1/\sqrt{\epsilon}$).

The expansion coefficients of sapphire impact the frequency directly giving rise to a frequency change of 5 to 6 PPM per degree Kelvin.

Thermal expansion of a copper rf shielding casing is a small but significant factor. Because microwave energy density at the walls of the casing is greatly reduced (typically 100 to 10,000 times, to enable a high sapphire Q), the frequency sensitivity to casing size is reduced by this same factor. Thus, the 15 PPM per degree Kelvin copper expansion shown in FIG. 2 is reduced to 0.15 PPM per degree Kelvin or less.

Short term thermal stability of approximately $1\mu°$ K can be attained at room temperature. However, even this very low variability, when coupled with a sapphire fractional frequency df/f sensitivity of $\approx6\times10^{-5}$ per degree K at room temperature or $\approx1.25\times10^{-5}$ per degree K at 77° K, gives fractional frequency variations of $1–6\times10^{-11}$ per degree K. These values of instability are substantially worse than attainable with excellent quality quartz oscillators.

On the other hand, if this sensitivity could be compensated to first order, the remaining response is a second-order effect of $\approx10^{-7}$ per (degree K)$^2$. If the temperature could be kept within only 0.01 degree K of the compensation point, the remaining linear sensitivity would be $\leqq1\times10^{-9}$ per degree K. Coupling this sensitivity value with the achievable temperature stability of $1\mu°$ K would result in a frequency stability of $\leqq10^{-15}$, a very attractive prospect.

Because there are no available internal compensation mechanisms that would give an effectively unchanging dielectric constant in the sapphire itself, it is necessary to rely on a physical part of the resonator structure to compensate for the thermal effect of a different part. In particular, if the thermal expansion profile of a second component material were sufficiently different from sapphire, and if a mechanism could be found to use this difference to give a frequency variation of opposite sign to that of the sapphire itself, a practical compensated resonator could be constructed.

A consequence of this type of thermal compensation design is that the various parts must be at the same temperature, i.e., in excellent thermal contact with each other. For example, a temperature differential of $1\mu°$ K, between the parts would give rise to the same large fractional variation ($1–6\times10^{-11}$ per degree K) variation in frequency that is to be obviated by the compensation mechanism. Fortunately, sapphire has one of the highest thermal conductivities for any solid material in the 40° to 150° K temperature range. Thus, sapphire could be mated with some other high thermal conductivity material in a composite resonator with a very short thermal time constant and overall high thermal conductivity to provide a sapphire resonator structure with high immunity to frequency variations due to variations in internal temperature gradients.

Since sapphire's expansion coefficient is relatively small compared to most materials, a natural choice is for a second material with a greater thermal expansion coefficient. FIG. 2 shows a comparison between sapphire and copper, which is a likely candidate by virtue of its high thermal conductivity. The difference between sapphire and copper values, shown in FIG. 2, can be used to tune a variable sapphire resonator. That then is the basis for the compensation mechanism of the present invention. It is useful to compare this difference with the temperature coefficient of the sapphire dielectric constants shown in FIG. 1. Such a comparison indicates that the compensation task is much easier at temperatures closer to 77° K than 300° K since dielectric coefficient variations are strongly reduced as the temperature decreases from 300° K to 77° K, while the copper-sapphire expansion difference is not so strongly reduced.

A comparison of the magnitudes of the two effects shows that a very precise and effective tuning mechanism is required to achieve compensation. However difficult that may seem, at temperatures near 77° K the task is not impossible. The difference in temperature expansion of copper and sapphire due to their respective expansion coefficients $\sigma_c$ and $\sigma_s$ evaluated at a temperature of 77° K is given by:

$$\frac{1}{x}\frac{\partial x}{\partial T} = \sigma_c(77°\,\text{K.}) - \sigma_s(77°\,\text{K.}) = 7\,\text{PPM/degree Kelvin},$$

where x is the resonator height while the dielectric tuning effect (one half of the dielectric constant variation, averaging perpendicular and parallel components) is $$\frac{1}{\omega}\frac{\partial \omega}{\partial T} = 13.5\,\text{PPM/degree Kelvin}$$

where $\omega$ is the frequency of a mode of a sapphire resonator. Combining these two equations, the required tuning sensitivity is given by $$\left|\frac{\delta\omega}{\omega}\right| = \frac{13.5}{7} \times \left|\frac{\delta x}{x}\right|. \quad (1)$$

That equation shows that a differential thermal expansion between copper and sapphire could be used to compensate the dielectric constant variation in sapphire at temperatures near 77° K if a mechanism could be found that is able to tune about twice (actually a ratio of 13.5 to 7) as much as it moves on a fractional basis, comparing Hertz per Hertz with centimeters per centimeter.

It is worth noting that compensation at near room temperature is much more difficult. A comparison of FIGS. 1 and 2 shows that increasing the temperature from 77° to 300° K increases the required compensation sensitivity given in Eq. (1) by approximately four times so that compensation at near room temperature for a high degree of stability on the order of $10^{-14}$ Hz per Hz would require mechanical tuning sensitivity for the resonator to be increased by approximately four times. Perhaps this could be accomplished by the use of a material with a greater coefficient of expansion, such as zinc, and/or by the use of relatively extreme geometries. However, successful compensation at room temperature has not yet been reported by anyone skilled in the art. The objective of this invention is to achieve such a high order of stability at near liquid nitrogen temperature (such as 87° K) with a mode Q of $10^7$.

SUMMARY OF THE INVENTION

A sapphire resonator cooled, for example, by liquid nitrogen ($LN_2$) or an inexpensive closed cycle cryocooler for operation at a chosen temperature in a range of about 40° to 150° K for use as an ultrastable oscillator includes a sapphire ring in an rf shielding casing having high thermal conductivity, so that while the casing is cooled and then regulated at the chosen operating temperature, such as 87° K, by a temperature regulator, additional heat from the resonating rf fields in the sapphire ring may be readily conducted out of the shielding casing. However, due to high thermal frequency sensitivity of the sapphire ring and the inability of the temperature regulator to maintain absolute constancy of the sapphire temperature, a nonsapphire tuning element is provided to compensate for any thermal frequency variation comprising separation of the sapphire ring into two equal annular parts, each part having a central web on a side opposite the other annular part, thus forming two re-entrant parts of the sapphire ring and a metal post between the webs separating the two re-entrant parts with a length selected to create a small gap between the two re-entrant parts that is strongly tuned to a $WGH_{n11}$ mode.

The metal for the post separating the re-entrant parts of the sapphire ring is selected to have a greater thermal expansion coefficient than that of sapphire, a very short thermal time constant and overall high thermal conductivity. An example of such a metal is copper. Metal alloys, such as brass (a copper alloy) and Invar (a steel alloy) used by Abramov et al., supra, have poor thermal conductivity compared to single-element metals such as pure copper or zinc at 77° to 87° K and so allow substantial thermal gradients across the resonator assembly. Because of differences in coefficients of thermal expansion between the two alloys, a thermal compensation mechanism can succeed only to the extent that the primarily temperature dependent expansion of the sapphire and of the compensating mechanism for the gap between the two re-entrant parts of the sapphire ring change equally but with opposite effect on the resonant frequency. If the compensation mechanism employs thermal connecting parts of different single-element metals or of different alloys, the compensation will succeed only to the extent the temperature of these parts follows each other. Once the gap is set for the selected operating temperature, it is expected that during operation the sapphire temperature will vary, thus affecting the resonant frequency, but as the sapphire temperature increases the metal post expands to increase the gap between the two re-entrant parts, thus creating a compensating (equal and opposite) effect in the sapphire resonant frequency, thereby stabilizing the sapphire resonant frequency within the rf shielding casing.

The two re-entrant parts of the sapphire ring and the metal spacing post between the webs must be thermally connected at an interface with high thermal conductivity and supported within the rf shielding casing by a structure of very low thermal conductivity. For the support of the assembly within the rf shielding casing, a thin metal of very low coefficient of thermal conductivity is employed, such as a thin-wall cylinder of stainless steel (alloy of iron and other metals with small percentages of carbon). To obviate any temperature gradient at the interface between the metal post and the two re-entrant parts of the sapphire ring, a gold-plated annular area on the webs of the re-entrant parts are indium soldered to the metal post for thermal integrity. A stainless steel bolt through the web of the upper re-entrant part of the sapphire ring, the post and the web of the lower re-entrant part of the sapphire ring holds the assembly of dual re-entrant parts with a gap spacing post in very good thermal contact with the housing of the electric temperature regulator supported on the base of the rf shielding casing with a thin-wall stainless steel cylinder.

The novel features that are considered characteristic of this invention are set forth with particularity in the appended claims. The invention will best be understood from the following description when read in connection with the accompanying drawings.

DETAILED DESCRIPTION OF THE INVENTION

Figure 1:
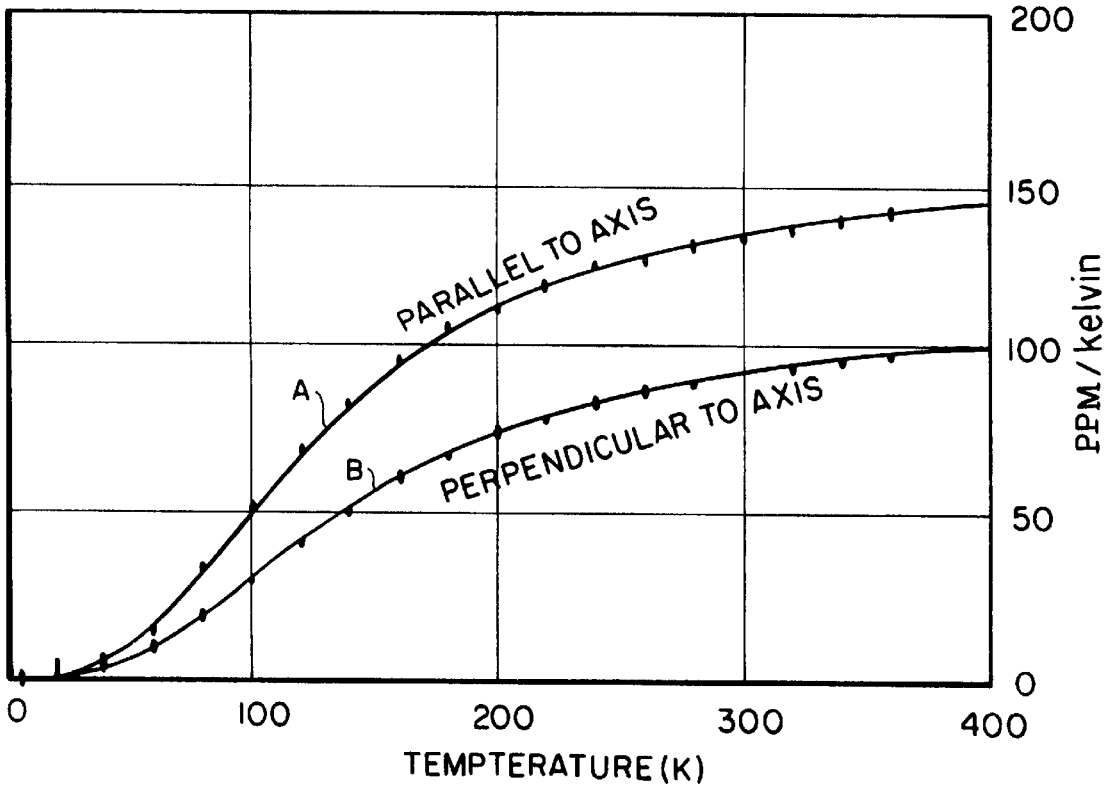
FIG. 1 shows a graph of temperature coefficients of the dielectric constants of sapphire crystal for the components parallel (graph A) and perpendicular (graph B) to the c-axis.

Before describing a preferred embodiment of the present invention, a hypothetical design will first be described with reference to FIG. 3 of a basic microwave sapphire resonator without any temperature compensation mechanism but cooled in a liquid helium Dewar for frequency stability. A sapphire wheel or ring 10 having an outside diameter of 5.0 cm and height of 2.0 cm is provided with a web 11 for supporting the resonator on a copper post 12 which is in turn supported on a copper base 13 by a stainless steel cylinder 14 having a thin wall for thermal isolation. The bottom end of the post 12 houses a component 15 comprising a temperature control sensor and a heating element within the stainless steel cylinder 14. A copper cylinder 16 and lid 17, together with the base 13, form an rf shielding casing that houses the sapphire resonator assembly secured to the base 13 by a stainless steel bolt 18.

The rf shielding casing housing the sapphire resonator assembly is placed in a vacuum tank (not shown) which is in turn placed in a liquid helium Dewar (not shown) for cooling the vacuum tank. The high thermal conductivity of the rf shielding casing will allow the dielectric resonator 10 to be cooled to very near the surrounding liquid helium temperature. The component 15 thermally isolated from the copper base 13 maintains the resonator temperature approximately constant, for example ~6° K, under control of external circuits (not shown). If the resonator is instead operated at a higher temperature, such as 77° K, the sensitivity of the sapphire dielectric constant to temperature increases to such an extent that small temperature variations which are present in all systems will prevent high frequency stability from being obtained.

Figure 4:
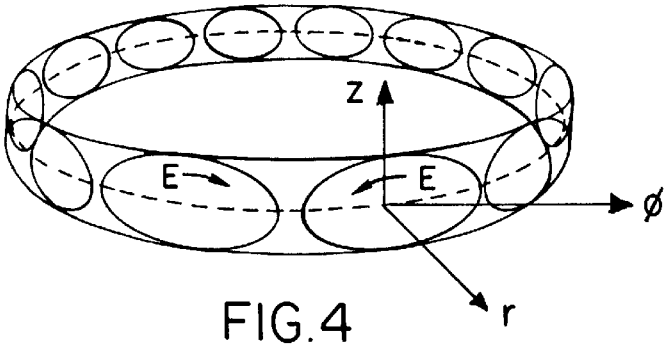
FIG. 4 illustrates the electric field configuration of E-field elliptical loops having their major axis on the center line of a sapphire ring resonator operating in the $WGH_{n11}$ mode where n=6.

Sapphire is a crystalline form of $Al_2O_3$. Its hexagonal crystal structure gives it a preferred c-axis in which direction the crystal exhibits different properties from those of its other two axes. With only a moderately high dielectric constant ($\epsilon \approx 10$), sapphire has not been proven to be a resonator unto itself. However, when formed in the shape of a wheel or ring and placed inside the cylindrical rf shielding casing, resonating rf fields excited by an external microwave source through a coupling port 19 are confined to the sapphire ring. FIG. 4 illustrates the distribution of elliptical E-field loops that are confined to the sapphire ring. Note that the major axis of the elliptical E-field loops are centered on the dashed center line of the sapphire ring while operating as a WG resonator in the $WGH_{611}$ mode. Four regions describe the radial field configuration of the WG mode of resonance: an inner evanescent region (inside an inner imaginary cylindrical boundary in space having a slightly greater radius than the inner wall of the sapphire ring); an outer evanescent region (surrounding the outer wall of the sapphire ring out to an outer imaginary cylindrical boundary in space); a standing wave region between the inner and outer evanescent regions; and traveling wave regions which are sectors of standing waves, i.e., pie-shaped regions where standing wave fronts are formed.

Figure 5:
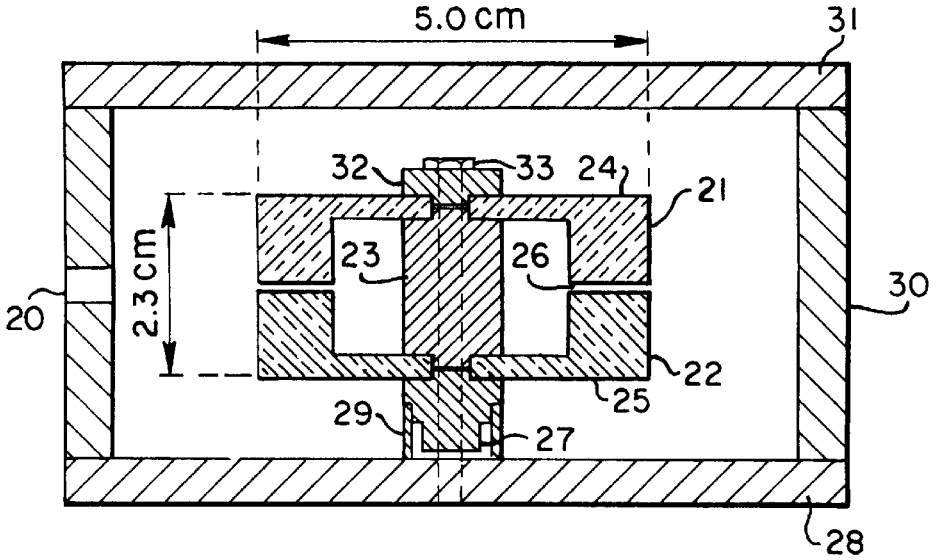
FIG. 5 illustrates diagrammatically a temperature compensated WG sapphire resonator cooled in a liquid nitrogen Dewar (not shown) in accordance with the present invention.

FIG. 5 illustrates a WG resonator for operation at near liquid nitrogen temperature, for example 87° K in one embodiment of the present invention described below. It uses thermal expansion as an added nonsapphire tuning element to compensate for thermal frequency variation of the sapphire of 0.5 cm in diameter. The resonator consists of a sapphire ring separated into two annular re-entrant parts 21 and 22 of equal height approximately equal to half the 2.3 cm height of the sapphire ring 21, 22. The two re-entrant parts are separated by a copper post 23 between webs 24 and 25 which, together with the two re-entrant parts 21 and 22, form a re-entrant sapphire ring. The post 23 is provided with a length that creates a small gap 26 of 0.05 cm between the two re-entrant parts selected for the dominant $WGH_{811}$ microwave mode in the example selected of operation at 87° K. Other modes at other temperatures will require a different gap, which may be predetermined before assembling the re-entrant parts on the spacing post 23.

Figure 2:
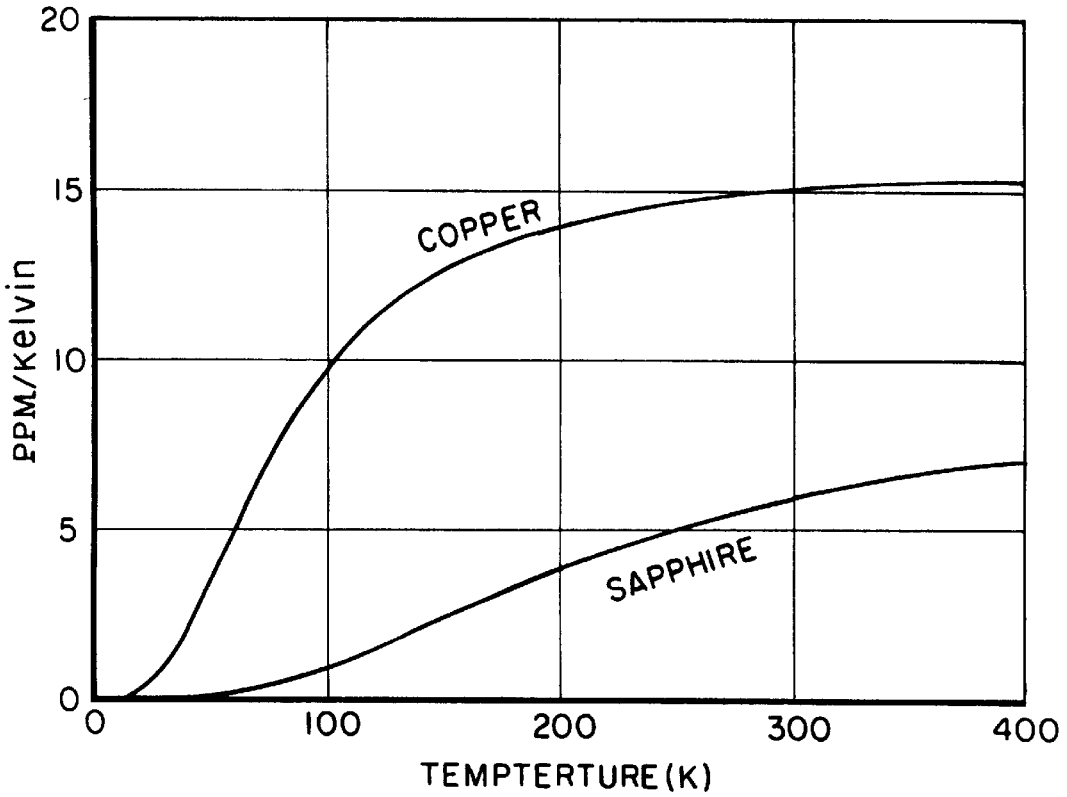
FIG. 2 shows a graph of thermal expansion coefficients for copper and sapphire.

If the 0.5 cm gap 26 between the two re-entrant parts is small the resonant frequencies of some of the WG modes are strongly tuned as the gap spacing changes. However, for available materials, a weak tuning effect would result if the post were only as long as the gap spacing, such as if the webs 24 and 25 were both at the opposite ends of their respective re-entrant parts 21 and 22, i.e., such as if the two re-entrant parts 21 and 22 had been formed by cutting the ring 10 of FIG. 3 through its centerline to create the gap 26 such that only a thin disk would be required for the post 23 to set a gap that separates the parts. For that reason each of the re-entrant parts 21 and 22 must be made with respective webs 24 and 25 as shown so that the post 23 may have a length almost equal the height of the entire sapphire resonator ring with a gap between the two re-entrant parts. Thus, with the two re-entrant parts in effect forming a resonant ring, a strong thermal tuning effect is achieved due to the difference between the thermal expansion coefficients of the copper post 23 and the sapphire re-entrant parts 21 and 22. The thermal expansion of the sapphire is a relatively minor effect, except that it does subtract from the compensating motion generated by the copper post. What is being compensated by the greater thermal expansion per degree Kelvin of the copper post, as shown in FIG. 2, is the thermal variation of the dielectric constant of the sapphire. By properly adjusting the length of the post 23 to the height of the resonant ring formed by the parts 21 and 22 with the gap 26 between them, the resonant tuning due to thermal expansion coefficients of the copper post will completely cancel the sapphire's inherent variation of the sapphire dielectric constant due to changes in temperature by introducing a variation in the gap through variation in the length of the post as the temperature changes. This complete cancellation of any variation in the sapphire dielectric constant due to temperature variations can be assured by calculating the post length required by the ratio of the coefficients of thermal expansion for the copper post 23 and the sapphire parts 21 and 22 and then adjusting the thickness of the webs 24 and 25 required to establish the small gap of 0.05 cm.

The design frequency of the WG resonator is established by other design parameters, including the mode that is excited through a port 20. That is accomplished by those skilled in the art using conventional tools, such as finite element programmed computational techniques, which are not a part of this invention that relates instead to architecture of the mechanism needed for providing temperature compensation to the degree of stability required of the resonant frequency for many applications. If the post is made of copper, this architecture may be used for compensation at temperatures near 77° K (in a range of about 40° to 150° K). For operating temperatures higher than, for example 87° K, selected materials with higher expansion coefficients (e.g. zinc) could be used for the post 23. Similarly, for lower operating temperatures, materials with lower expansion coefficients may be used.

Figure 3:
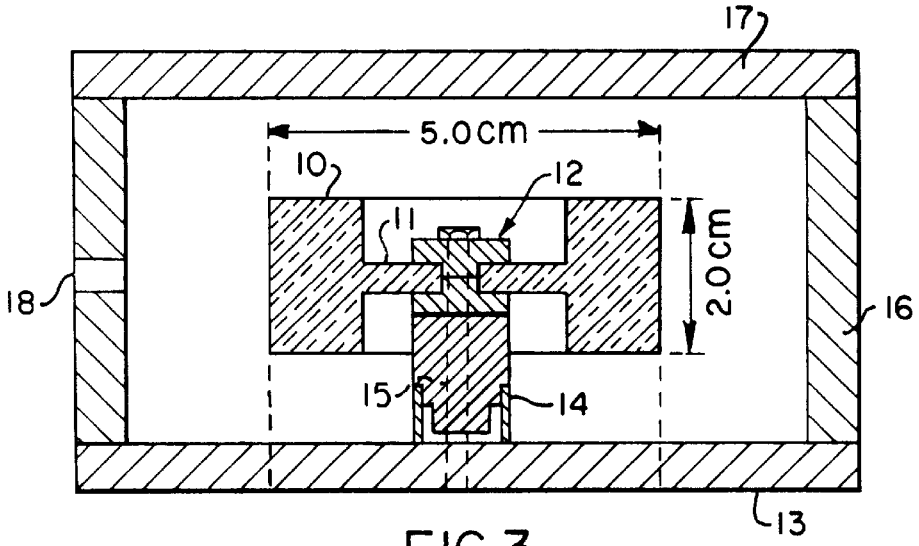
FIG. 3 illustrates diagrammatically a cylindrical cross-section of a WG sapphire resonator cooled in a liquid helium Dewar (not shown).

As in the dielectric resonator of FIG. 3, the resonator subassembly of FIG. 5 consisting of sapphire parts 21, 22 and post 23 is provided with a component 27 (temperature sensor and heating element) supported on a copper base plate 28 by a thin-wall stainless steel cylinder 29. Although the component 27 is shown in thermal contact with the post 23, it would be sufficient to heat that post through the web of the lower re-entrant part 22. A copper cylinder 30 and copper top plate 31 form an rf shielding casing with the base plate 28 to complete the WG sapphire resonator assembly that then need only be placed in a vacuum tank, after which the vacuum tank is placed in a liquid nitrogen Dewar for cooling.

While good thermal conduction must be provided between the post 23 and the two sapphire re-entrant parts for good performance, it is important to maintain good thermal isolation of the resonator assembly supported on the base plate 28 for optimum performance. The stainless steel cylinder 29 used for support of the resonator assembly within the shielding casing has a very low coefficient of thermal conduction, but to further enhance the thermal isolation sought, further thermal isolation means may be provided such as by a dual-wall base with significant space between two walls of the base.

In order to achieve high frequency stability, the high Q of the sapphire resonator must not be degraded by the post 23 while good thermal conduction between the post and the sapphire re-entrant parts 21 and 22 must be maintained in order to eliminate any temperature gradient between the post and the re-entrant parts. Good thermal conduction may be assured by first providing a gold-plated annular area formed by vapor deposition, for example, on the surfaces of the re-entrant parts 21 and 22 abutting the post 23. In addition a copper sleeve is press-fitted into the axial aperture provided for a bushing 32 (optional) and stainless steel bolt 33 passing through the center of both re-entrant parts and the temperature regulation component 27 into a threaded hole in the base plate 28. A corresponding reduced diameter portion protruding from each side of the post 23 is press-fitted into the sleeves in the apertures of the re-entrant posts.

Figure 7:
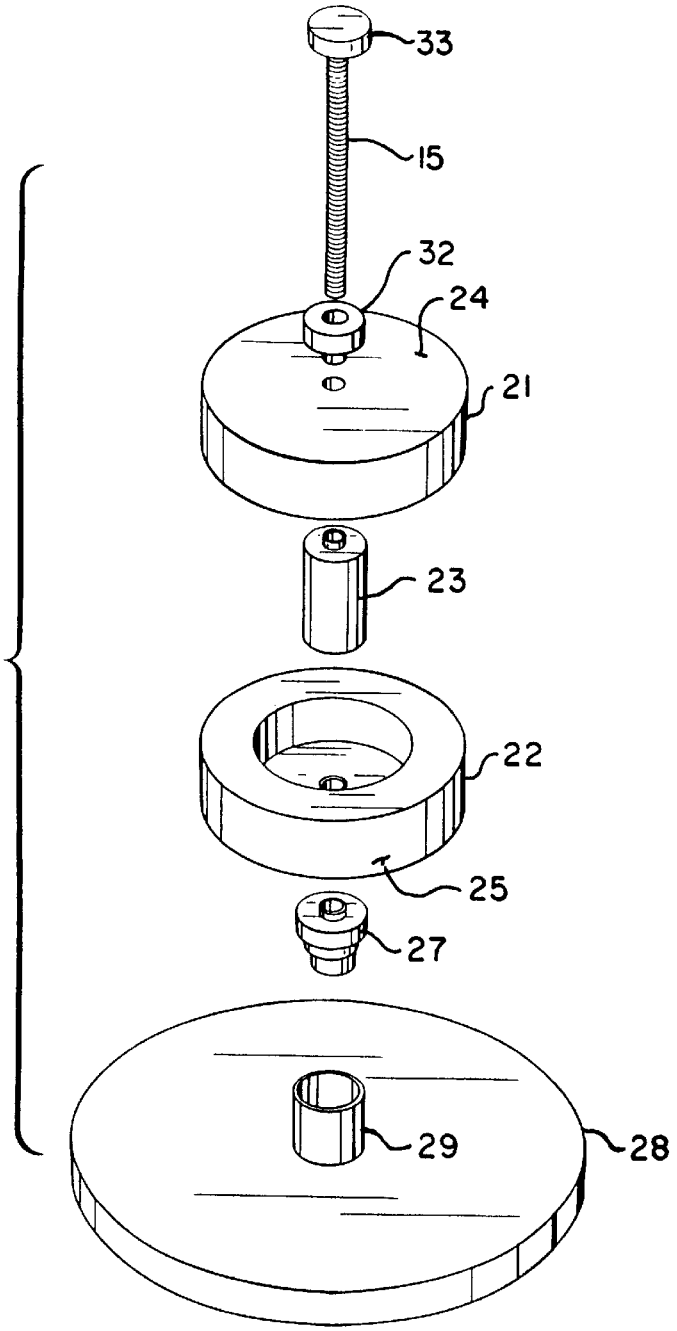
FIG. 7 is an exploded isometric view of the temperature compensated WG sapphire resonator of FIG. 5 with a supporting copper base plate but without a copper casing supported by the base plate over the sapphire resonator.

The bolt may alternatively pass through the regulation component 27 as well and be threaded into the base plate 28 as shown or into a nut not in thermal contact with the base plate. The function of the bolt is to hold the sapphire resonator assembly in good thermal contact with the temperature regulation component 27 which is controlled by external means (not shown). FIG. 7 illustrates that bolt 33 in an exploded isometric view of a practical realization of the present invention described with reference to FIG. 5, where the reference numerals introduced for the various elements in FIG. 5 are retained for elements in FIG. 7 without further description thereof. To complete the assembly of the sapphire resonator comprising the two re-entrant parts 21, 22 and the post 23, molten indium is applied to the abutting surfaces of the re-entrant parts and pressure is applied to the re-entrant parts while the indium solidifies.

Thus, because the compensating tuning effects are due to the variable gap 26 (see FIG. 5) between the re-entrant parts 21 and 22, thermal gradients between those parts is minimized by providing high thermal conductivity from the temperature regulator through the post 23 to the re-entrant parts. Consequently, good thermal conductivity is required between the regulation component 27 and the post 23. To assure that, a layer of indium (a soft metal) is provided on the abutting surface of the temperature regulator. As a cylindrical extension from that abutting surface is drawn into the sleeve in the aperture of the lower re-entrant part 22 by the bolt 33, the soft layer of indium will flow in the joint between component 27 and the post 23 to assure good thermal conductivity through the joint. Alternatively, indium solder may be used to provide a thermal connection to the lower re-entrant part 22 through its web 25.

It has been found that a copper post of approximately 20–30% of the sapphire ring diameter provides the required thermal conductivity, and an axial position for the post minimizes any degradation of the electromagnetic energy in the selected $WGH_{n11}$ mode concentrated near the outer perimeter of the sapphire ring formed by the re-entrant parts.

The compensation mechanism can be understood as follows. As the temperature is raised, the mode frequencies tend to be lowered due to the increasing dielectric constant and thermal expansion of the sapphire re-entrant parts reducing the gap. However, at the same time, the gap is widened due to the large thermal expansion of the copper post. The resulting increase in gap volume (dielectric constant $\epsilon=1$ compared to $\epsilon\approx10$ for sapphire) tends to raise the frequencies. These cancelling effects can be balanced to provide complete compensation at some temperature, which in this example has been chosen to be 87° K.

Figure 12:
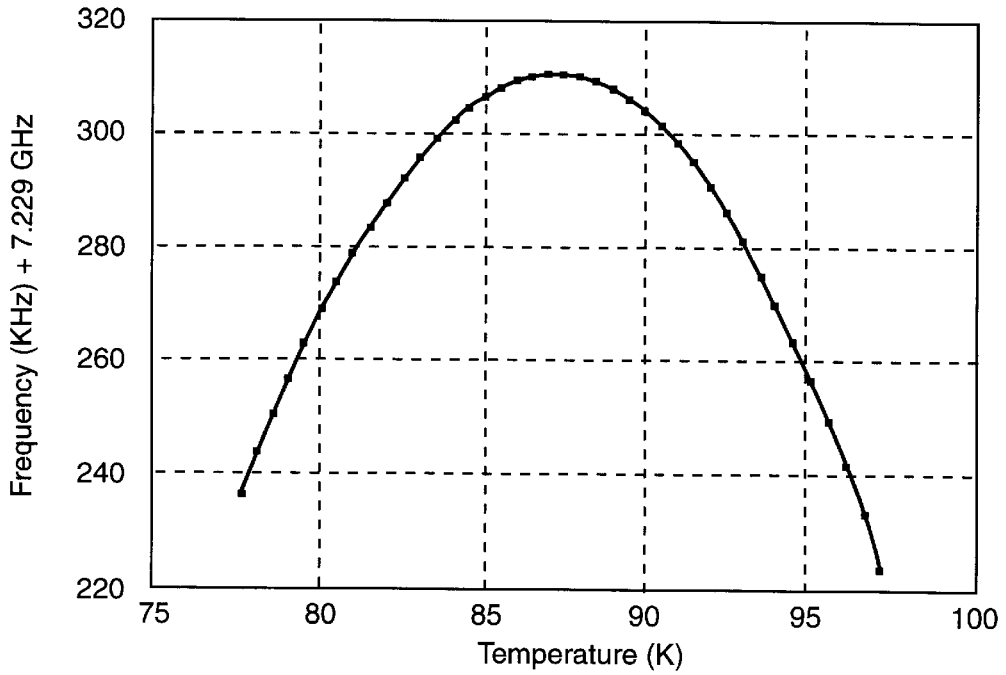
FIG. 12 is a graph of frequency dependence of temperature compensation for the $WGH_{811}$ mode at 7.23 GHz showing a turnover temperature near 87° K.

As previously discussed, the sapphire element itself is the primary temperature-dependent element in this resonator. Thus, the compensated central subassembly (consisting of the two sapphire re-entrant parts and the copper post) is thermally isolated from the copper If shielding casing, and held at a stabilized operating temperature of 87° K by action of a temperature regulator. The exact temperature selected depends on the experimentally determined turnover temperature for the sapphire resonator subassembly, e.g., 87° K as shown in FIG. 12. The temperature of the rf shielding casing must also be controlled for optimal frequency stability, even though its thermal sensitivity is 100 to 10,000 times reduced from that of the central subassembly. This is accomplished by means of a second temperature regulating feedback system (not shown) that stabilizes the casing temperature to a value near 77 K.

Variation of Mode Frequency with Gap Spacing

As indicated in Eq. 1, the copper/sapphire composite resonator requires a high tuning sensitivity in order to achieve compensation at a temperature near 77° K. The following presents two different approaches to evaluating the sensitivity of the frequency of the fundamental $WGH_{n11}$ mode to changes in a small gap at the resonator center plane.

With a knowledge of the mode configuration, first estimate this sensitivity using simple circuit models that incorporate the resonator dimensions in a natural way. This approach has the advantage of illuminating the qualitative features of the design problem.

A programmed finite element computational technique can then be used to estimate mode frequencies, both with and without a gap. Accuracy of this methodology depends on the number of nodes used to characterize the geometry, with fields being evaluated only at the node points, and with the space between fitted to a simple power law behavior.

It is known that the magnitude of the tuning can be relatively large, as required by Eq. 1, because electromagnetic boundary conditions can give rise to larger energy in the gap region than in the (high $\epsilon$) sapphire. In particular, this is true for modes with large electric fields perpendicular to the gap such as the $WGH_{n11}$ mode family chosen.

Gap Sensitivity Estimation by Circuit Analysis

Figure 6:
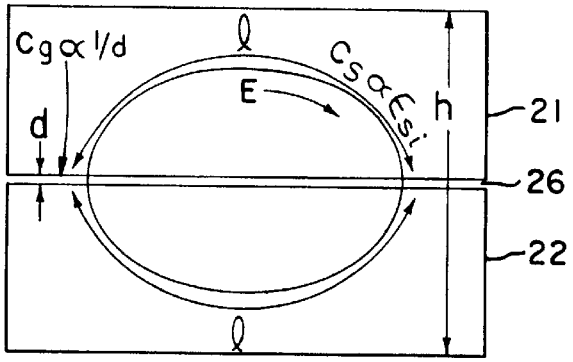
FIG. 6 is a diagram of one E-field loop showing elements of series-capacitance model for a sapphire ring resonator having a vacuum gap centered on the center line of the ring as shown in FIG. 4.

In order to demonstrate that the above approach is sound, the circuit analysis approach is used to estimate a lower bound for the tuning sensitivity. The $WGH_{n11}$ mode is characterized by a chain of approximately elliptical loops of electric field in the z-$\phi$ plane (as shown in FIG. 4) linked by loops of magnetic field in the r-$\phi$ plane. Because of the continuity of the electric field lines and of displacement current, the effect of the gap can be estimated using a simple series-capacitance model. Conventional circuit analysis gives the resonant frequency $\omega=\sqrt{1/LC}$, where L and C are the inductance and capacitance of the circuit, and assuming that any change in effective inductance is small:

$$\frac{\Delta\omega}{\omega} \approx \frac{1}{2}\frac{\Delta C}{C}$$

where $\omega$ is the resonance frequency and $\Delta\omega$ is the change of frequency as a function of $\Delta C$, which is the change in capacitance C due to a change in temperature which in turn changes the dimension of the gap 26. Each electric field loop traverses a path length l through the respective re-entrant parts 21, 22 of the sapphire ring with dielectric constant $\epsilon_s$ and then a gap distance d with $\epsilon=1$ as shown in FIG. 6. Because of the continuity of displacement current, the sapphire capacitance $C_s$ can be approximated as $C_s\,\epsilon_s/l$ where l is the loop length and the gap capacitance $C_g$ as $C_g\,1/d$. By combining these capacitances in series the dependence of the capacitance C on the gap spacing d is estimated as:

$$\frac{\Delta C}{C} \approx -\frac{d\epsilon_s}{l+d\epsilon_s}.$$

A lower bound for the tuning effect is estimated by assuming that the loops are as long as possible, touching both the resonator top and bottom. Approximating the elliptical loops as circular the loop length becomes $$l \approx \frac{\pi}{2}\times h$$

where h is the sapphire resonator height. Combining these two equations in the limit of small d, shows the frequency sensitivity in terms of distance sensitivity to be $$\frac{\Delta\omega}{\omega} \approx -\frac{1}{2}\frac{\Delta C}{C} \approx \frac{1}{2}\frac{g\epsilon_s}{l} \approx \frac{\epsilon_s}{\pi}\times\frac{d}{h}$$

where d is the dimension of the gap between the resonator top and bottom halves, or $$\left|\frac{\delta\omega}{\omega}\right| \geqq \frac{\epsilon_s}{\pi}\times\left|\frac{\delta x}{x}\right| \tag{2}$$

where $\delta x \equiv \delta d/h$ is the fractional variation of the resonator height.

Since $\epsilon_s \approx 10.5$, a comparison of Eqs. 1 and 2 shows that the circuit model predicts a sensitivity more than sufficient to achieve complete compensation at 77° K. That is, the tuning sensitivity of $\epsilon_s/\pi \approx 3$ is larger than the required value of 13.5/7 from Eq. 1.

Gap Sensitivity Estimation by Finite Element Calculation

Figure 8:
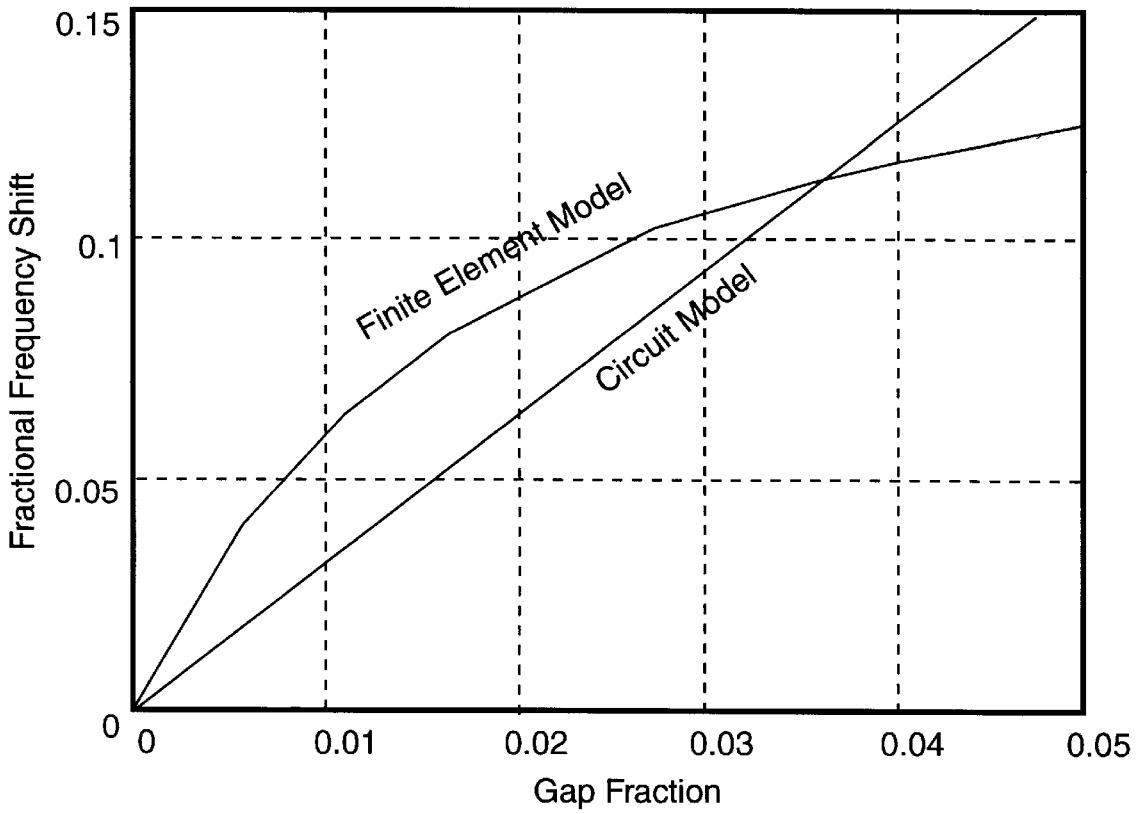
FIG. 8 is a graph of gap sensitivity estimated by circuit analysis and finite element calculation.

FIG. 8 shows a comparison of the circuit model prediction with calculations using a recently developed finite-element methodology. This CYRES 2-D programmed method takes advantage of sapphire's cylindrically symmetric dielectric properties to allow a simplified and more accurate calculation of WG mode frequencies and fields than was previously possible. The finite-element approach allows relatively complicated geometries to be easily treated, such as geometries shown in FIG. 7.

As expected, this more accurate calculation gives a larger tuning effect than the (lower bound) circuit model prediction, but somewhat surprisingly shows an additional effect. As shown in FIG. 8, the finite element method predicts that tuning effectiveness (the slope of the curve) will be degraded for gaps as small as 0.02 of the resonator height.

This reducing sensitivity is shown to be due to a feature not included in our simple circuit model. For larger gaps (and also for large n, where the wide elliptical loops for E as shown in FIG. 6 tend to be narrow and tall instead) finite element solutions exhibit a substantial horizontal (azimuthal) electric field component near the gap, showing that the gap capacitance $C_g$ is bypassed by azimuthal displacement currents in the sapphire. That is, a more accurate circuit model would contain an additional capacitance $C_{sg}$ acting in parallel with $C_g$.

The variation in tuning sensitivity with gap spacing provides a means to adjust its strength in order to match other requirements. Thus the gap may be varied to provide compensated operation in a particular mode at a particular temperature.

Figure 9:
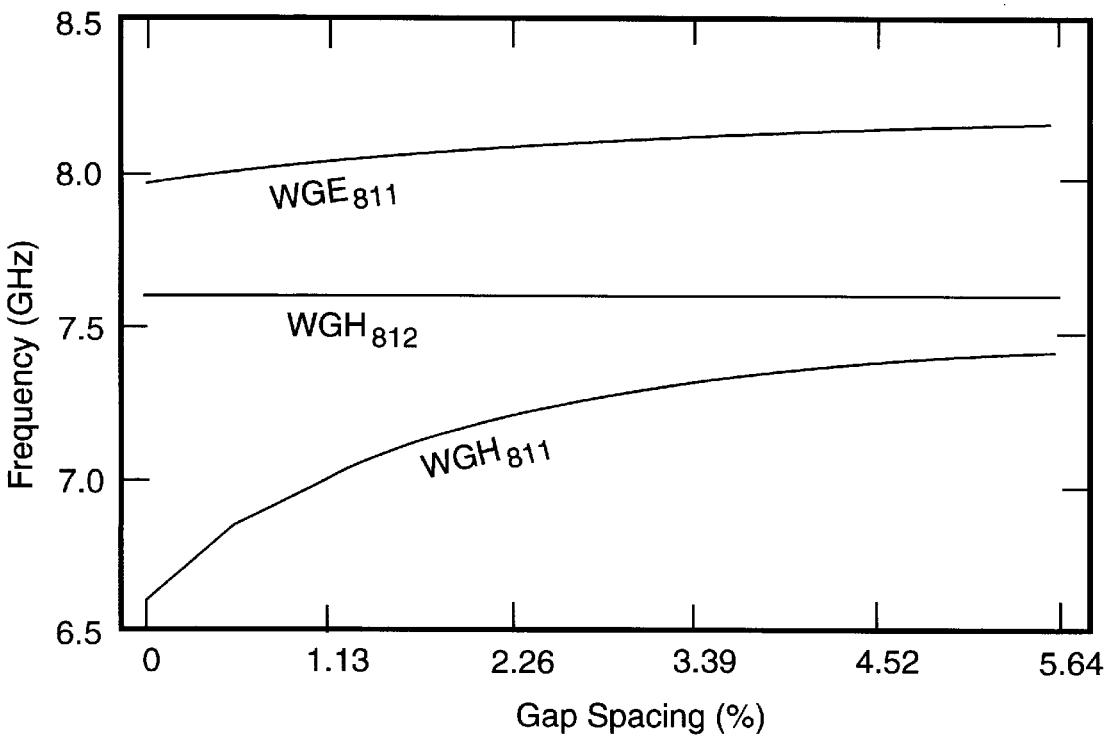
FIG. 9 is a graph of frequency dependence on gap spacing for electromagnetic modes from various families for the compensated WG sapphire resonator using finite element calculation.

Not all mode families are found to be strongly affected by changes in the gap spacing. This is to be expected, for example, for modes with very small E fields in the gap region. FIG. 9 shows the frequency dependence on gap spacing for three examples of modes with different characteristics for their electric fields, namely, partially compensated, uncompensated and compensated modes. In order of decreasing sensitivity to gap spacing they are:

- The $WGH_{811}$ mode with a maximum of vertical E field in the gap shows a rapid increase in frequency with increasing gap spacing.
- The $WGE_{811}$ mode has a maximum of radial (horizontal) E field at the gap and shows a slight frequency increase.
- The $WGH_{812}$ mode with a sign reversal of vertical E field at the center, and very small values in the gap shows almost no change in frequency.

These results quantitatively confirm that a strong vertical E field in the gap region, as exhibited by the $WGH_{n11}$ mode family, and displayed in FIG. 4, is essential to achieve high sensitivity to gap spacing. For this geometry it is also the "fundamental" mode family, showing the lowest microwave frequency and highest mode confinement for any given azimuthal wave number n. This family is thus an ideal candidate for use in a composite compensated resonator. Similar effects have been previously used to provide frequency variability for sapphire resonators (M. E. Tobar and D. G. Blair, "Analysis of a Low Noise Tunable Oscillator Based on a Tunable Sapphire Loaded Superconducting Cavity," *Proc. 45th Symposium on Freq. Control,* pp. 495–499, (1991); and D. G. Santiago, G. J. Dick and A. Prata, Jr., "Mode Control of Cryogenic Whispering-Gallery Mode Sapphire Dielectric-Ring Resonators," *IEEE Trans. MTT,* Vol. 42, pp. 52–55, (January, 1994)).

Experimental Tests of Mode Frequencies

A resonator was constructed with configuration and dimensions as shown in FIG. 5, and with the parts mechanically and thermally bonded by means of pure indium solder. A clean (scraped) molten indium pool on each end of the copper post was mated in turn to an evaporated gold layer on the sapphire parts. After cooling to 77° K, the frequency, Q, and coupling coefficient was measured for each of 69 resonant modes from 6.6 GHz to 10.75 GHz. This list was then preliminarily matched by frequency with the finite element data. Analysis of the electromagnetic visualization of the resonator cross section using the CYRES 2-D software conclusively identified the experimental modes for each family.

FIG. 9 shows the excellent agreement between theory and experiment for the three mode families previously discussed which are the $WGH_{812}$ family for the uncompensated mode, $WGE_{811}$ family for the partially compensated mode which has a small effect but not enough to be useful, and $WGH_{811}$ family for the compensated mode which has a significant compensation effect in the range of zero to about 1% of gap spacing variation, i.e., change in sapphire resonator height due to increase in gap spacing.. The data indicates a frequency difference of less than 0.4%.

Temperature Tuning Rates

Figure 10:
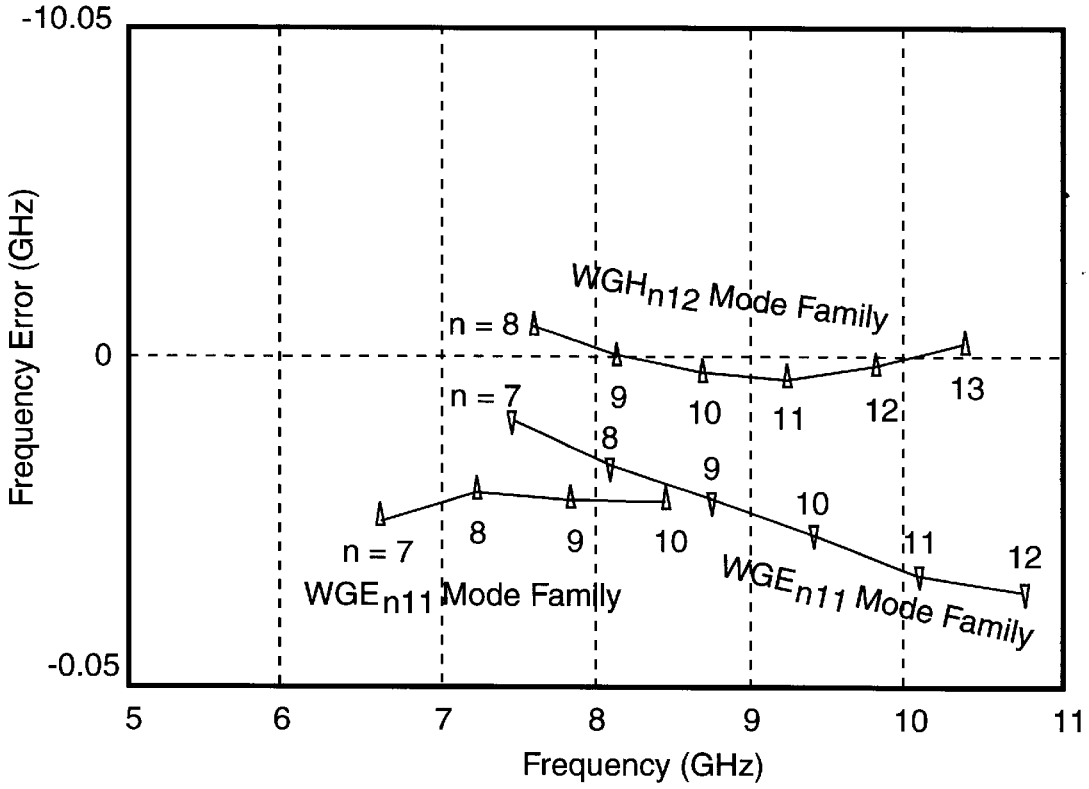
FIG. 10 is a graph of frequency difference between experimental results and finite element calculations for several mode families.

A direct demonstration of the effectiveness of our compensation mechanism can be shown by experimental measurement of the rate of frequency change with temperature at 77° K. As shown in FIG. 10, the experimental points with positive values of frequency change indicate modes that are actually overcompensated at 77° K where the members of the mode families $WGH_{n12}$, $WGE_{n11}$ and $WGH_{n11}$ are designated by the numbers which range from n=7 to 10 for the last family listed, from n=7 to 12 for the penultimate family listed and n=8 to 13 for the first family listed. They will have turnover temperatures (complete compensation) above 77° K which is desirable since this allows for relaxed cooling requirements. Negative values indicates undercompensation or even no compensation (if values are approximately the same as expected from the sapphire dielectric variation alone), and a zero value would indicate a turnover temperature at exactly 77° K.

A comparison of calculated and measured tuning rates in FIG. 10 shows excellent agreement. Sensitivity to small changes in the gap spacing was calculated with the finite element software. The results were combined with values for the expansion coefficients of copper and sapphire (FIG. 2) and a fitted value for the sapphire dielectric temperature dependence. As shown in FIG. 1, the dielectric variation values can be expected to vary between 9.4 PPM/Kelvin (perpendicular) and 16.75 PPM/Kelvin (parallel) at 77° K. However this represents data measured at kilohertz frequencies and may be modified at microwave frequencies.

The fitted values were 11 PPM/Kelvin and 10.5 PPM/Kelvin for the $WGH_{n11}$ and $WGH_{n12}$ mode families, respectively, and 7 PPM/Kelvin for the $WGE_{n11}$ family. It is to be expected that the WGE families would have a lower value, because the electric fields in this case are almost entirely in the r-ϕ plane shown in FIG. 4, and so correspond to the lower "perpendicular" results, while the values for the WGH modes have a substantial fraction of their electric fields "parallel" to the z axis.

Figure 11:
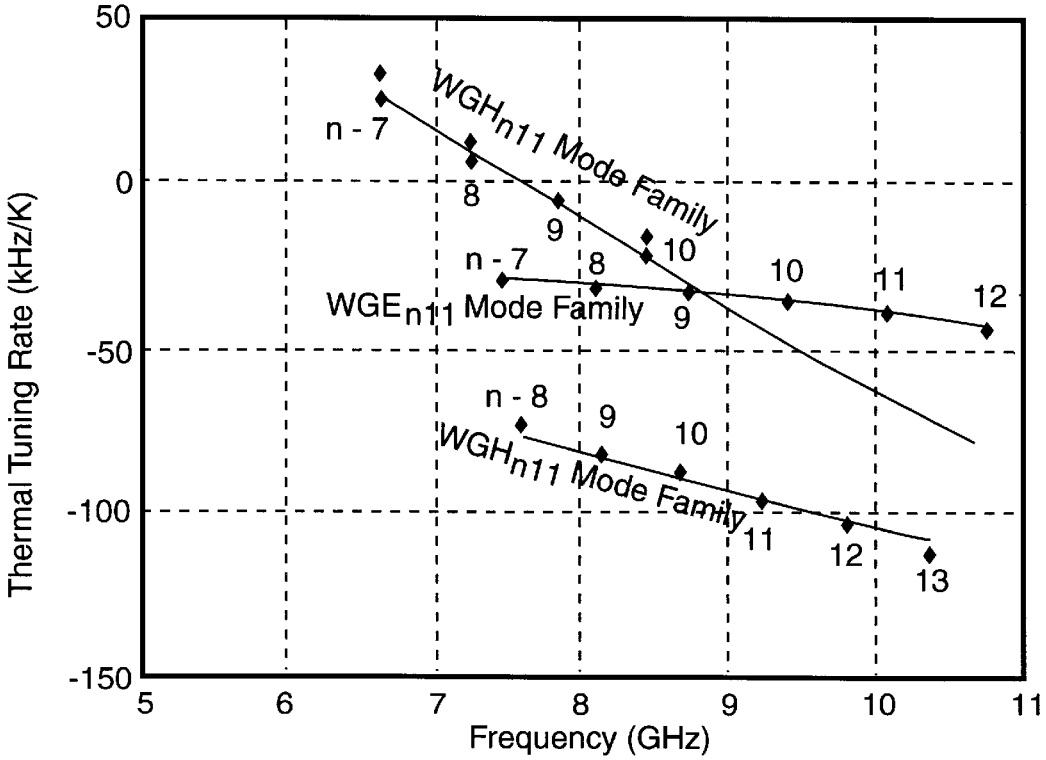
FIG. 11 illustrates calculated lines and experimental points of temperature tuning rates at 77° K for three dominant (lowest frequency) mode families in a sapphire/copper compensated resonator with a gap of 0.050 cm.

Both calculated and experimental values in FIG. 11 show a weakening of the compensation effect for higher mode numbers n (higher frequencies) that was not predicted by the simple circuit model as discussed in relation to FIG. 8. Thus, modes with $n \geqq 9$ in the $WGH_{n11}$ mode family are undercompensated at 77° K, and so would require operation at a lower temperature. However the n=8 modes at 7.23 GHz are just slightly overcompensated, and so can be operated at a temperature near 77° K, as desired. More detailed calculations show that higher frequency compensated operation is possible using a smaller gap spacing where the compensation effectiveness is not so strongly dependent on the mode number.

Compensated Resonator Operation

One of the two $WGH_{811}$ modes was chosen for further study. This mode showed the highest quality factor of any of the compensated modes with $Q=1.8\times10^6$. FIG. 12 shows a plot of the resonance frequency for this mode showing a turn-over temperature of 87.09° K. A quadratic approximation in the vicinity of the peak gives:

$$\frac{\delta f}{f} \approx 1.17\times10^{-7}(T-87.09)^2,$$

where f is the resonant frequency in Hertz.

A residual linear thermal coefficient due to imperfect temperature adjustment $\delta T=T-87.09$ can be derived from the slope of the curve as $$\frac{1}{f}\frac{\partial f}{\partial T} \approx 2.34\times10^{-7}\delta T. \tag{3}$$

Eq. (3) allows the thermal requirements that would allow such a resonator to achieve its ultimate stability of $\delta f/f \approx 10^{-14}$ to be estimated. If the temperature is held at the turnover temperature with an accuracy of $\delta T=1$ millidegree, the slope given by Eq. 3 will be less than $2.34\times10^{-10}$ per Kelvin, requiring a stability of 43 micro-Kelvins to achieve $10^{-14}$ stability. Accuracy and stability are distinguished in this discussion, because the δT accuracy needs to be held over a relatively long operational time period (possibly days or months), while the strength of the sapphire oscillators is in short-term stability. Thus, in order to achieve a stability of $10^{-14}$ for a time period of e.g. 100 seconds, the temperature would need to be stable to 43 micro-Kelvins for 100 seconds, but could vary up to 1 milliKelvin over the time period of operation. These requirements are easily met using conventional thermal regulation technology as developed for use by other types of frequency standards.

Oscillator Stability

An oscillator was constructed, stabilized by the $WGH_{811}$ mode of the compensated resonator. Preliminary oscillator tests were accomplished with open loop control of the resonator temperature, and with the casing temperature not regulated, but determined by direct contact with a liquid nitrogen bath. The stability of the oscillator was characterized using a hydrogen maser frequency standard as reference.

Figure 13:
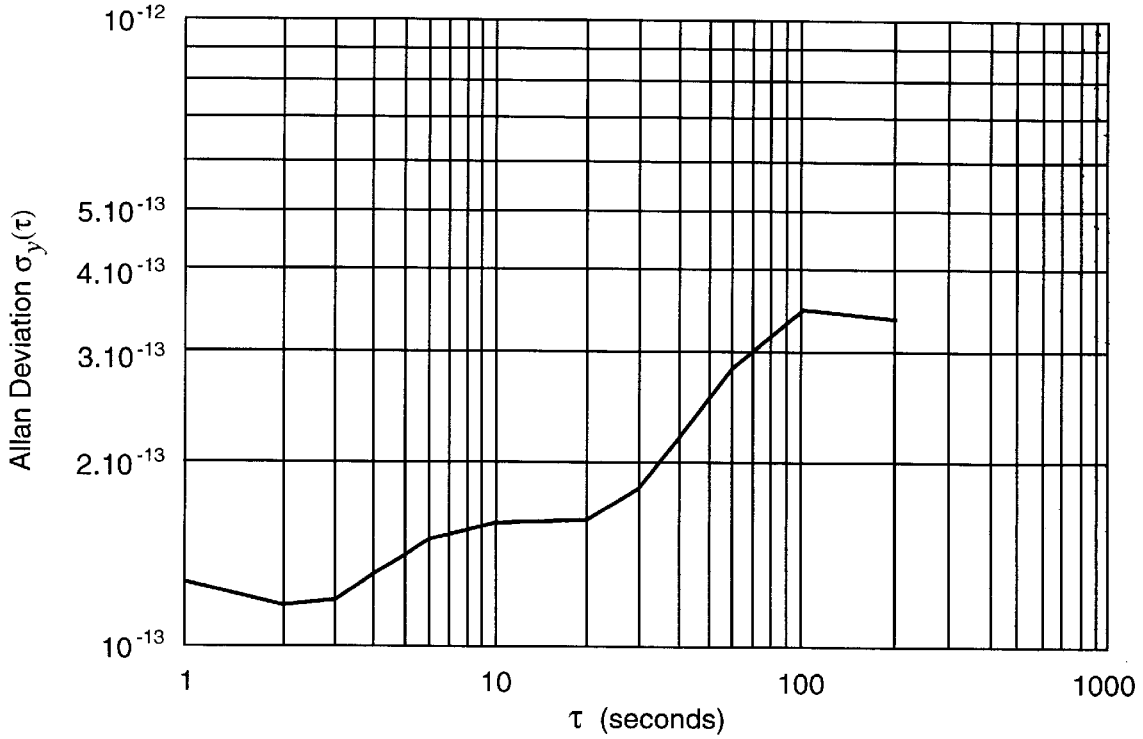
FIG. 13 is a graph of measured frequency stability for a temperature compensated sapphire oscillator.

As shown in FIG. 13, the Allan Deviation of frequency variation was measured to be $1.2–3.5\times10^{-13}$ for measuring times 1 second$\leqq\tau\leqq$100 seconds. For the shorter measuring times ($\tau\leqq$30 sec.), this stability is superior to that of the best available quartz oscillator. There was a large but constant frequency drift during the course of the measurements which may be due to slow relaxation in the soft indium solder joints. A frequency stability $10^{-14}$ for this resonator is projected with stabilized can temperature and with a mode quality factor of $Q=10^7$.

Although particular embodiments of the invention have been described and illustrated herein, it is recognized that modifications may readily occur to those skilled in the art. For example, it is relatively easier to achieve compensation at lower temperatures, such as 60° or 70° K. The resonator could be operated at a higher mode (n>8) or be made less re-entrant using a shorter copper post to move the turnover temperature from 87° K to a lower temperature, and vice-versa for operation at a higher temperature. Other design parameters may be varied, such as the temperature coefficient of the dielectric constant or the difference between the thermal coefficients of the post the dielectric ring by proper selection of materials. Consequently, it is intended that the claims be interpreted to cover such modifications and equivalents thereof.

What is claimed is:

1. A temperature compensated dielectric resonator cooled to an appropriate temperature selected in a range of about 40° K to 150° K for use as an ultrastable oscillator operating in said range, comprising a dielectric ring in a cylindrical rf shielding casing having high thermal conductivity, said dielectric ring being separated into two annular parts with a gap between said annular parts selected for operation in a selected mode of a Whispering Gallery ring resonator of its $H_{n11}$ family of modes, at an appropriate temperature selected in said range for said resonance mode, a metal post between said two annular parts of said dielectric ring re-entrantly attached to said annular parts so that the length of said metal post and the distance between the interface points between said post and said annular parts are substantially longer than said gap which separates said annular parts, the length of said metal post being selected for spacing said annular parts with said gap, the metal of said post having a greater thermal expansion coefficient than that of the material of said dielectric ring, a very short thermal time constant and overall high thermal conductivity, means for thermally connecting annular parts and said metal post at an interface thereof with high thermal conductivity, means for supporting in said cylindrical rf shielding casing said annular parts with said metal post thermally connected therebetween to define a subassembly, said supporting means for said subassembly having a very low conductivity to provide thermal isolation of the resonator and the copper base plate of the casing, and means for temperature control thermally joined to said subassembly for maintaining said subassembly substantially at said appropriate temperature for said selected $WGH_{n11}$ resonating mode of said dielectric resonator.

2. A temperature compensated dielectric resonator as defined in claim 1 wherein said material of said dielectric ring is sapphire.

3. A temperature compensated dielectric resonator as defined in claim 2 wherein said appropriate temperature is near 77.

4. A temperature compensated dielectric resonator as defined in claim 3 wherein said appropriate temperature is 87 K and said selected Whispering Gallery resonating mode is $H_{811}$ at 7.23 GHz.

5. A temperature compensated dielectric resonator as defined in claim 1 wherein said two annular parts comprising said dielectric ring each have a separate central web substantially less in thickness than the height of said dielectric ring, said central web of each part being on a side opposite the other annular part to define two re-entrant parts of said dielectric ring with a gap between said annular parts, said metal post being thermally attached to the facing surfaces of said respective central webs of said corresponding annular parts, thereby providing said means for thermally connecting said annular parts and said metal post.

6. A temperature compensated dielectric resonator as defined in claim 5 wherein said dielectric ring has a mode quality factor of $Q>10^6$ and the metal of said post is copper for high tuning sensitivity of said gap in order to stabilize the resonant frequency of said dielectric ring separated into two re-entrant parts, said metal post serving to vary said gap as the temperature of said subassembly varies during operation, thereby creating a compensating effect in said resonant frequency in order to achieve stability of said sapphire resonator on the order of $\delta f/f\approx10^{-14}$.

7. A temperature compensated dielectric resonator as defined in claim 6 wherein said means for supporting said subassembly comprising thermally connected re-entrant parts and said metal post therebetween in said cylindrical rf shielding casing includes a cylinder of metal having a low coefficient of thermal conductivity between said means for temperature control and a base plate of said cylindrical rf shielding can, said means for temperature control being contained within said cylinder of metal without any direct thermal connection to said base plate, and said subassembly is supported over said means for temperature control with a high thermal conductivity layer of indium therebetween for assuring a thermal junction of high conductivity between said temperature regulator and said subassembly.

* * * * *